US005526720A

United States Patent [19]

Locotos

[11] Patent Number: 5,526,720

[45] Date of Patent: Jun. 18, 1996

[54] WRENCH DEVICE FOR MINE ROOF BOLTS

[76] Inventor: Frank M. Locotos, 536 Hunters Path, Bridgeville, Pa. 15017

[21] Appl. No.: 259,780

[22] Filed: Jun. 14, 1994

[51] Int. Cl.[6] ..... B25B 13/06

[52] U.S. Cl. ..... 81/121.1; 81/125; 29/527.1; 29/469.5

[58] Field of Search ..... 81/55, 121.1, 125, 81/124.1; 405/259.5, 259.6; 411/82, DIG. 908, DIG. 930; 29/527.1, 530, 469.5

[56] References Cited

U.S. PATENT DOCUMENTS

| | | | |
|---|---|---|---|
| 1,509,680 | 9/1924 | Meek | 81/124.1 |
| 2,676,506 | 4/1954 | Schultz | 81/124.1 |
| 4,564,315 | 1/1986 | Rozanc | 405/259.5 X |

FOREIGN PATENT DOCUMENTS

| | | | |
|---|---|---|---|
| 291873 | 5/1916 | Germany | 81/124.1 |

*Primary Examiner*—D. S. Meislin
*Attorney, Agent, or Firm*—Ansel M. Schwartz

[57] ABSTRACT

The present invention is a wrench device for installing a mine roof bolt. The device comprises a body portion having a socket end for holding and turning a nut of the mine roof bolt. There is also a retractable bolt stoppage mechanism engaged through the body portion. The bolt stoppage mechanism when raised prevents the bolt from threading onto the nut during resin mixing so as the nut is turned, the bolt is also turned. In a preferred embodiment, the body portion has a hollow central cavity which extends into the socket. The bolt stoppage mechanism can comprise a head portion and a rod portion slidably engaged within said central cavity. The bolt stoppage mechanism can also comprise a spring for biasing the stop member away from the socket end.

6 Claims, 2 Drawing Sheets

WRENCH DEVICE FOR MINE ROOF BOLTS

FIELD OF THE INVENTION

The present invention is related in general to mining tools. More specifically, the present invention is related to a wrench device for installing a mine roof bolt.

BACKGROUND OF THE INVENTION

It is known in the past to use mine roof bolts to support the excavated earth strata in a mine. As shown in FIG. 1, one type of roof bolt consists of an elongated bolt which is held in the bore hole with resin. The end extending from the bore hole typically has a bearing plate secured with a nut. The nut is tightened to a recommended level to tension the bolt.

In a conventional installation, a bore hole is first drilled to the required depth. A resin cartridge is then inserted into the bore hole followed by the bolt. The bolt is then shoved to the top of the hole. The resin cartridge ruptures and fills the space between the bolt and the bore hole. To mix the resin, the bolt is typically turned a number of times. After mixing, the bolt is held snugly against the roof until the resin hardens. Once the resin hardens, the nut is tightened to tension the bolt.

A domed nut is typically used to ensure that the nut and bolt turn together during mixing of the resin. The domed nut has a breakaway top to allow the bolt to thread through the nut during the higher torque of tensioning.

However, there is a problem in that the domed nut necessary to provide the temporary stoppage is much more expensive than a conventional nut.

The present invention allows a conventional hex nut (or nut of any design—as square) to be used with the described mine roof bolt. A novel wrench and associated system is disclosed which provides the described dual function of turning the nut and bolt as one during resin mixing and turning the nut relative to the bolt during tightening.

SUMMARY OF THE INVENTION

The present invention is a wrench device for installing a mine roof bolt. The device comprises a body portion having a socket end for holding and turning a nut of the mine roof bolt. There is also a retractable bolt stoppage mechanism engaged through the body portion. The bolt stoppage mechanism, when raised, prevents the bolt from threading onto the nut during resin mixing so as the nut is turned, the bolt is also turned to mix the resin.

In a preferred embodiment, the body portion has a hollow central cavity which extends into the socket. The bolt stoppage mechanism can comprise a stop portion and rod portion slidably engaged within the central cavity. The bolt stoppage mechanism can comprise a spring in the central cavity for biasing the stop member away from the socket end.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
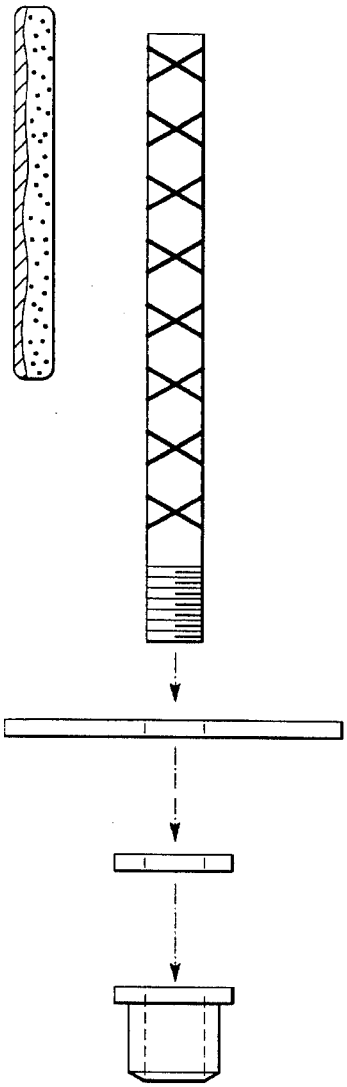
FIG. 1 PRIOR ART
FIG. 1 is a schematic representation showing a prior art mine roof bolt.
Figure 2:
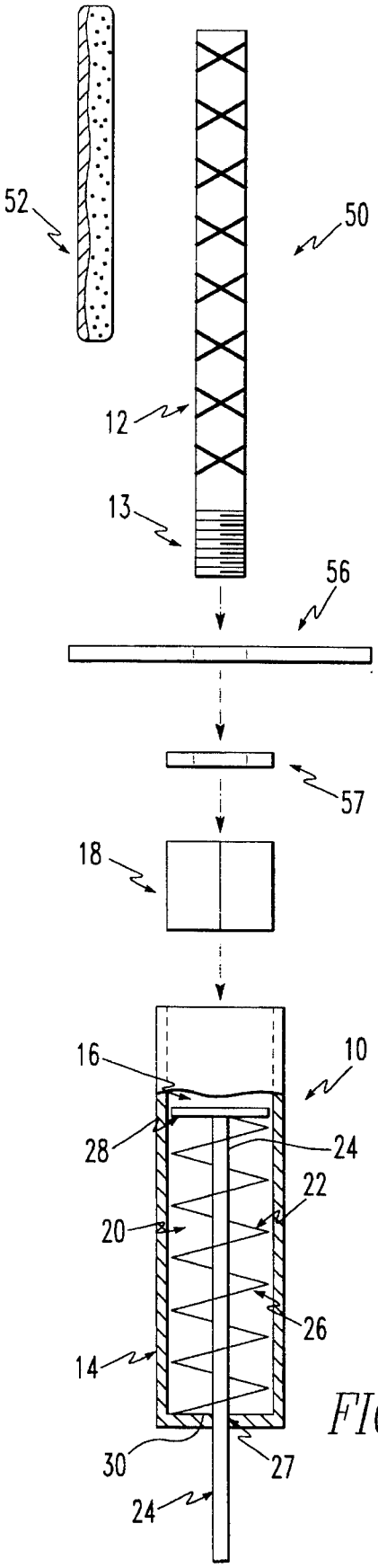
FIG. 2 is a schematic representation showing the mine roof system of the present invention.

Referring now to the drawings wherein like reference numerals refer to similar or identical parts throughout the several views, and more specifically to FIG. 2 thereof, there is shown a wrench device 10 for installing a mine roof bolt 12. The device 10 comprises a body portion 14 having a socket end 16 for holding and turning a nut 18 of the mine roof bolt 12. There is also a retractable bolt stoppage mechanism 20 engaged through the body portion 14. The bolt stoppage mechanism 20, when raised, prevents the bolt 12 from threading onto the nut 18 so as the nut 18 is turned, the bolt 12 is also turned to mix resin.

In a preferred embodiment, the body portion 14 has a hollow central cavity 22 which extends into the socket and the bolt stoppage mechanism 20 comprises a rod portion 24 and a head portion 28. Since the bolt stoppage mechanism 20 turns the body portion 4, either the rod portion 24 or the head portion 28 preferably engages against the body portion 14. In one embodiment, the body portion 14 can have a square hole 27 and the rod portion 24 has a slightly smaller square cross section. In another embodiment, the head portion 28 can have a cross section to match the socket end 16. The bolt stoppage mechanism 20 can also comprise a spring 26 for biasing the rod portion 24 away from the socket end 16. The spring 26 is fixedly connected, such as by welding, at each end to the head portion 28 of the stoppage mechanism 20 and a bottom lip portion 30 of the body portion 14.

Figure 3E:
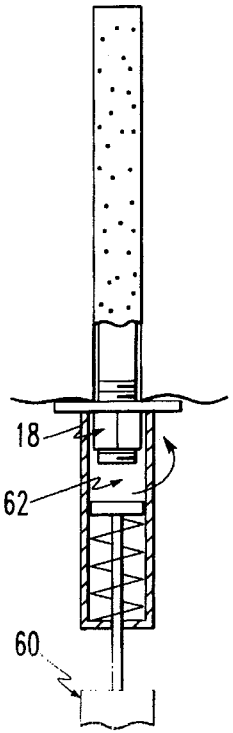
FIGS. 3*a*–3*e* are schematic representations illustrating the operation of the mine roof wrench device.
Figure 3D:
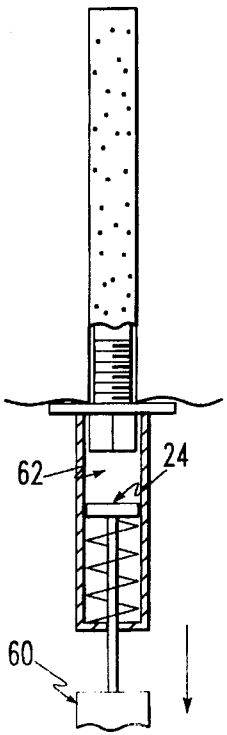
Figure 3C:
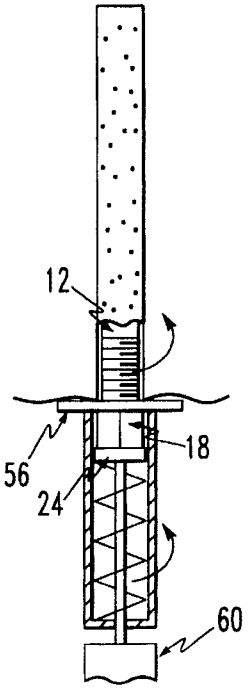
Figure 3B:
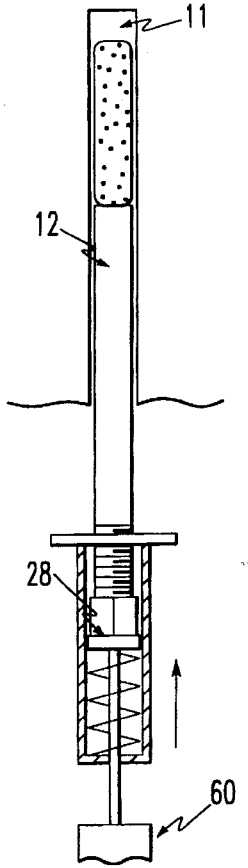
Figure 3A:
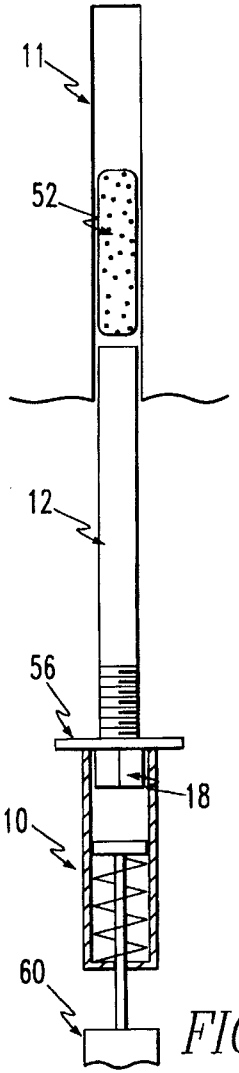

In the operation of the wrench device 10, as illustrated in FIGS. 3*a*–3*e*, a bore hole 11 is first drilled to the required depth. As shown in FIG. 3*a*, the bolt 12, with attached nut 18, and plate 56 is then set in the wrench device 10. The wrench device 10 is connected to a conventional machine drive 60. The resin cartridge 52 is placed in the bore hole 11 ahead of the bolt 12. As shown in FIG. 3*b*, the machine drive 60 lifts the bolt 12 vertically towards the roof. The bolt 12 slides into the device 10 until the nut 18 touches the head portion 28. As shown in figure 3*c*, once the plate 56 touches the roof and the bolt 12 is pushed all the way up, the machine drive 60 spins the wrench device 10 to turn the nut 18. The head portion 28 presses against the nut 18 to prevent the bolt 12 from threading through the nut 18. In this manner, the nut 18 and bolt 12 turn as one to mix the resin of the now-punctured resin cartridge 52. Once the resin is sufficiently mixed, the machine drive 60 is stopped from spinning and held against the nut 18 until the resin hardens in the bore hole 11 about the bolt 12 (typically from several seconds to about a minute). After the resin hardens, the drive machine 60 is lowered, several inches, as shown in FIG. 3*d*, creating a gap 62 between the nut 18 and the head portion 28. Finally, as shown in figure 3*e*, the machine drive 60 turns the wrench device 10 to torque the bolt 12. The nut 18 threads onto the fixed bolt 12. The spring 26 assists in holding the body portion about the nut 18 since the spring 26 is connected to the body portion 14 and the stoppage mechanism 20 as the machine drive 60 is lowered somewhat, thus allowing the rod portion 24 to move down while the body portion is maintained against the nut 18.

As shown in FIG. 2, the present invention is also a mining bolt system 50. The system 50 comprises a mining bolt 12 having a threaded end 13 and a resin cartridge 52 for anchoring the mining bolt 12 within a bore hole. A nut 18 is threadingly engaged on the threaded end 13. A bearing plate 56 is disposed through the threaded end 13 between the nut 18 and rock face. The system 50 also comprises the wrench device 10 as previously described.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A mining bolt system comprising:

a mining bolt having a threaded end;

a resin cartridge for anchoring the mining bolt within a bore hole;

a nut threadingly engaged on the threaded end;

a bearing plate disposed through the threaded end between the nut and rock face; and a wrench device for installing the mining bolt in the bore hole, said wrench device comprising a body portion having a socket end for holding and turning a nut of a mine roof bolt and a retractable bolt stoppage mechanism engaged through the body portion, said bolt stoppage mechanism in a first position preventing the bolt from threading onto the nut so as the nut is turned, the bolt is also turned to mix resin from the resin cartridge.

2. A device as described in claim 1 wherein the body portion has a hollow central cavity which extends into the socket, said bolt stoppage mechanism comprising a head portion and a rod portion slidably engaged within said central cavity.

3. A device as described in claim 2 wherein the bolt stoppage mechanism comprises a spring for biasing the stop member away from the socket end, said spring fixedly connected at each end to the head portion and a bottom lip portion of the body member, respectively.

4. A device as described in claim 3 including a washer disposed between the nut and bearing plate.

5. A method for installing a mine roof bolt comprising the steps of:

inserting a resin cartridge into a bore hole in strata;

placing a mine roof bolt into the bore hole;

pushing the bolt through the resin cartridge so resin is released;

rotating the mine roof bolt by turning a wrench about a nut of the bolt with a stoppage mechanism of the wrench contacting the bolt so the nut cannot thread onto the bolt;

lowering the stoppage mechanism; and rotating the wrench after the resin has hardened.

6. A method for installing a mine roof bolt comprising the steps of:

inserting a resin cartridge into a bore hole in strata;

placing a mine roof bolt into the bore hole;

pushing the bolt through the resin cartridge so resin is released;

rotating the mine roof bolt with pressure from a machine drive by turning a wrench about a nut of the bolt with a stoppage mechanism of the wrench contacting the bolt so the nut cannot thread onto the bolt;

removing pressure from the machine drive on the wrench; and rotating the wrench after the resin has hardened.

* * * * *